United States Patent [19]

Hein et al.

[11] 3,938,852

[45] Feb. 17, 1976

[54] ELASTOMERIC STRUCTURAL BEARING

[75] Inventors: Richard D. Hein, Wabash, Ind.; John A. Welch, Cuyahoga Falls; James E. Britton, Akron, both of Ohio

[73] Assignee: The General Tire & Rubber Company, Akron, Ohio

[22] Filed: Dec. 19, 1974

[21] Appl. No.: 534,269

Related U.S. Application Data

[63] Continuation of Ser. No. 394,692, Sept. 6, 1973.

[52] U.S. Cl. ..... 308/3 R; 267/152

[51] Int. Cl.[2] ..... F16C 25/02

[58] Field of Search ..... 267/140, 141, 152, 153, 267/33, 151; 308/1 R, 241, 3 R, 244, 245

[56] References Cited

UNITED STATES PATENTS

| | | | |
|---|---|---|---|
| 3,081,993 | 3/1963 | Wallerstein, Jr. | 267/33 |
| 3,625,501 | 12/1971 | Hein | 267/152 |

*Primary Examiner*—James B. Marbert

[57] ABSTRACT

An improved elastomeric bearing structure adapted for use to support members such as beams or decks upon piers, foundations, sills, etc., to accommodate static and dynamic loading, thermal movement, non-parallel surfaces or rotation caused by beam deflection and the like. Bearing structure includes a monolithic elastomeric member which defines two substantially parallel side surfaces bounded at their peripheries by a curvilinear edge surface; the elastomeric member is confined at its edge surface by a plurality of elongated inextensible tension members disposed in both vertically spaced apart relation and horizontally offset or staggered relation and of selected accumulative height to allow selected adjacent areas of the edge surface to remain unconfined. Such structure permits a substantial increase in horizontal shear deflection for a bearing of specified thickness while also permitting superior accommodation to rotation caused by beam deflection and limiting deflection caused by vertical loading.

7 Claims, 8 Drawing Figures

ELASTOMERIC STRUCTURAL BEARING

This is a continuation of application Ser. No. 394,692, filed Sept. 6, 1973.

BACKGROUND OF THE INVENTION

This invention generally pertains to bearing members adapted to support beams or decks upon piers, foundations, sills, etc., and more particularly pertains to an improved elastomeric bearing structure which, solely through compressive and shear strain or deformation, will accommodate imposed static and dynamic loading, thermal movement, non-parallel loading and the like.

In the construction of large structures, such as a bridge or a building, an important factor which must be taken into consideration is the movement of the individual structural members relative to one another. Such movement can be due to a number of factors, such as the thermal expansion and contraction of the materials being used and also external forces, such as wind, earth movement and the like on the structure along with the static and dynamic loads applied to the members themselves. In a bridge structure, horizontal beams are suspended between spaced vertical supports with the ends of the beams terminating at the supports. In such an application, it is necessary that provision be made for the thermal expansion and contraction of each beam as well as the angular or rotational movement caused by beam deflection from traffic loads on the bridge. The present invention, as herein disclosed, comprises an improved elastomeric bearing for such applications.

The basic concept of supporting bridge beams or the like by means of load bearing elastomeric material is a pertinent application of elastomers as a structural material. The applied unit loads and various movements are compatible with the load bearing and elastic characteristics of the material, while design and fabrication requirements fall readily into accepted practices in the rubber industry. Beam movements are accommodated by rubber deformation, not relative motion. It has been proven that elastomeric bearings may effectively support the various reactions and accommodate the required movements of structures within the load bearing and elastic properties of the material. Considerable cost advantages are obtained and the necessity is eliminated for design of expensive moving parts and their subsequent maintenance.

The design of an elastomeric bearing begins with the understanding that a rubber compression spring is a device by which the gravity forces of a structure are to be balanced by the "memory" of a specific elastomeric compound or its capability to regain its original form. Rubber has this ability to deform and comply to extreme load conditions, and will predictably resist the resulting stress and return to normal upon release of the load.

Toward this end, extensive research has been devoted to study the load deformation characteristics of load bearing rubber. Because it is a complex material, designing to ultimate limits is also somewhat complex. Keeping the spring concept in mind, bearing design is begun on the simple premise that the less the compound has to deform or remember, the better and longer it can function properly. Keeping initial compression deflection and deformation within limits which are low enough to insure against further deformation, or settling, during the life of the structure, becomes the principle ruling criteria.

Probably the most important characteristic of rubber that makes it suitable for use in bridge bearings is the relative ease with which its compression modulus can be altered to meet the designer's needs. The compressive modulus is highly dependent upon the geometrical confinement of the rubber, which has been characterized by the term "Shape Factor" and is defined as the ratio of the effective bearing area under load to the exposed area free to bulge as a result of rubber displacement.

For example, if a bearing receives 500 p.s.i. dead load, and the rubber thickness is such that the perimeter surface area free to bulge is equal to the load area (shape factor of 1), the bearing will compress about 30% of its thickness immediately upon placement of the beam, and with time, will continue to creep or bulge out the sides. However, if the rubber thickness is reduced until this bulge area is only one-sixth the load area (shape factor of 6), deformation will then be less than 5% of thickness and subsequent creep or progressive deformation well be inconsequential or non-existent.

It should be noted, that in shape factors above 6, durometer change has no significant effect upon compressive deflection; a valid indication that a degree of rubber confinement has been reached where compression stability is permanent. This shape factor versus compression strain relationship, therefore, is simply a precise statement of the correct degree of rubber confinement required for the load ranges involved.

To summarize these load bearing design procedures, two principal controls are used: (1) a correct number of square inches in the plan area to support a given load, and (2) an effective thickness allowed for bulge which is correctly proportioned to the plan area in order to eliminate failure from settling or permanent deformation.

It should be noted that the shape factor effect assumes that bearings are restricted from any lateral movement between load surfaces by way of chemically bonding the elastomer to sole plates or having the elastomer in contact with a rough surface exhibiting a high frictional coefficient, such as concrete and the like. A simple unbonded bearing will function satisfactorily only if the load surfaces are permanently clean and dry and no outward surface creep between the load surfaces and the surfaces of the bearing is possible. In terms of functional longevity, the compression or settling life of an unbonded bearing depends substantially on the ability of the coefficient of friction between the bearing and the beam to be sufficiently high to prevent spreading. In applications of the present invention, there is intended to be substantially no slippage or creep between surfaces of the elastomeric body surfaces and the loading surfaces when reliance is placed on frictional engagement.

Designing the bearing to accommodate the various movements of the beam is a matter of selecting the thickness as a function of the amount of lateral movement anticipated. This comparison is necessary to determine. the shear strain in the rubber. In order to minimize high shear loads being transmitted to the pier or foundation, the elastomeric mass should not be extended laterally more than 25% of its thickness each way while under load, for example, as an empirically sound design rule.

As known, the rubber mass moves equally well in any direction. Since allowable shear travel will be 0–25%, for example, total allowable movement is half the thickness of the bearing. Conversely, the bearing thickness must be twice the expected total movement. Although it is unlikely that beams will be installed at temperatures representing the exact midpoint of their expansion, any additional strain or deformation should fall well below the ultimate permissable shear strain.

Assume that a beam or deck proves to have a potential horizontal movement equal to the thickness of the rubber. The basic bearing of a selected shape factor then provides only half the required travel capacity because of its thickness. In the prior art, another identical bearing has been positioned on top to gain the required thickness and both are bonded to a common steel plate at their common load surfaces. This double bearing still has the same load carrying capacity as the single basic bearing, but the accumulated lateral travel capacity of the two bearings now equals the expected beam movement. However, the common steel plate adds thickness to the composite bearing which does not contribute to such lateral travel capacity as permitted by the present invention.

The flexural or bending of beams under load causes a rotating movement of the upper surface of the bearing. The rotating load effect on the rubber is different from the effect of vertical dead beam load for several reasons. Dead load compression, evenly applied, causes transfer of rubber mass into the side bulge volume. The live rotating load causes an increase in bulge on that side of the bearing facing the beam length with a corresponding reduction on the opposite face. The actual difference in effect on the rubber is a uniform outward mass movement in the case of dead load and a non uniform mass transfer during bearing rotation.

Still another load effect is due to permanent non-parallelism of load surfaces. In this instance, side transfer is permanent and, over a fairly wide latitude, does not materially reduce the load carrying capacity of the bearing. While rubber has the ability to conform to a new permanent working position, care must be used not to exceed the "memory" of the compound.

DESCRIPTION OF THE PRIOR ART

The present invention is an improvement to structures such as disclosed in German Pat. No. 1,179,978, published Oct. 22, 1964. Related U.S. Pat. Nos. 3,504,905, 3,514,165 and 3,544,415 disclose laminated structures of elastomer and metal bonded together which serves to give a high shape factor for loads in compression and to utilize the accumulative lateral or shear deformation of successive layers of rubber.

Information concerning application of elastomers is found in publications respectively entitled NATURAL RUBBER IN BRIDGE BEARINGS (Bulletin No. 7) and ENGINEERING DESIGN WITH NATURAL RUBBER (Third Edition 1970) both published by the Natural Rubber Producers Research Association, 19 Buckingham Street, London W.C.2., England. The foregoing publications including the patents will serve as references to provide additional information concerning the following detailed description.

SUMMARY OF THE INVENTION

The present invention provides an improved elastomeric bearing structure having a high shape factor, yet with a high shear displacement relative to the thickness of the structure.

The present invention also provides an improved elastomeric bearing structure wherein essentially the entire effective height, and substantially the entire volume of the bearing, is rubber which is adapted for maximum lateral deformation with optimum pressure distribution of vertical and horizontal loading.

The present invention further provides an improved elastomeric bearing structure which may be fabricated more simply and at less expense than prior art structures.

The present invention further provides an improved elastomeric bearing structure of simple design and of less weight for a given load application and installation space requirement.

The foregoing and other provisions and advantages are accomplished with an elastomeric bearing structure including a monolithic elastomeric support body defining a lower surface and an upper surface adapted to support a load in a structure and defining a peripheral edge about the perimeters of the lower and upper surfaces. A plurality of tension support members such as rods or rings are disposed in continuous confining relation about the peripheral surface and embedded in the peripheral edge. Adjacent tension support members are provided or different peripheral lengths or diameters and accordingly are disposed in both offset or staggered relationship and in vertically spaced apart relationship above one another within the support body. An elastomeric sheath may be disposed in bonded weather protective relation over the peripheral edge surface and tension support members. The tension support members are adapted to divide the peripheral surface into selected smaller areas subject to bulging when a compressive load is exerted on the lower and upper surfaces of the support body. The accumulative vertical dimensions of the tension support members should be in the order of not less than about 40% of the total thickness of the support body. The support body may include a central body bounded by an elastomeric retaining body disposed in bonded relationship about the periphery of said central body and between the central body and the tension support members. In such case the tension support members are embedded in the outer edge of the retaining body. The retaining body confines the support body to transmit forces from a compressive load on the central body through the central body to the retaining body. The retaining body is confined in turn by the tension support members. The bearing structure may comprise a plurality of the support bodies as described which are joined in cooperative disposition through connection with a spanning member. Sole plates may be provided in bonded relation to the upper and/or lower surfaces of the bearing structure as appropriate.

BRIEF DESCRIPTION OF THE DRAWINGS

Referring to the drawings.

DESCRIPTION OF THE PREFERRED EMBODIMENTS

As a brief definition of terms used herein, the inextensible tension support members may also be termed rings, rods, or the like. Elastomer and rubber as used herein are used interchangeably to denote appropriate synthetic or natural rubbers. Like elements in the different embodiments disclosed are identified with the same numbers.

Figure 2:
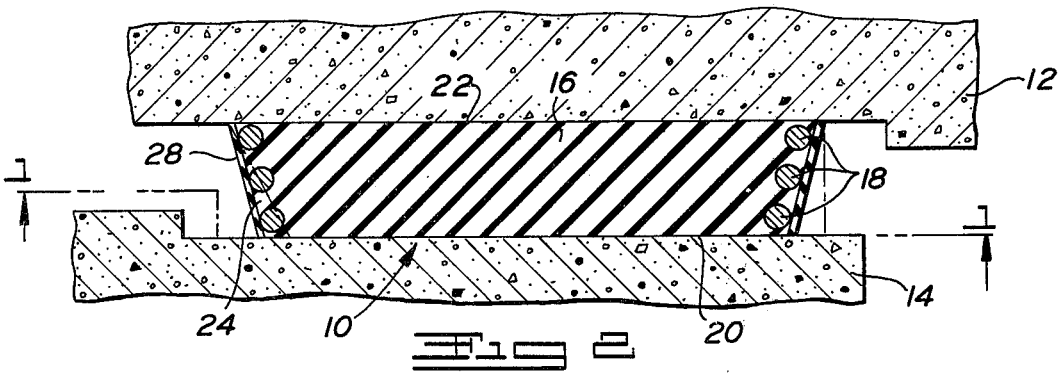
FIG. 2 is a sectional and elevational view of an installation of the elastomeric bearing of the present invention, including a sectional view of the bearing taken at line 2—2 of FIG. 1.
Figure 1:
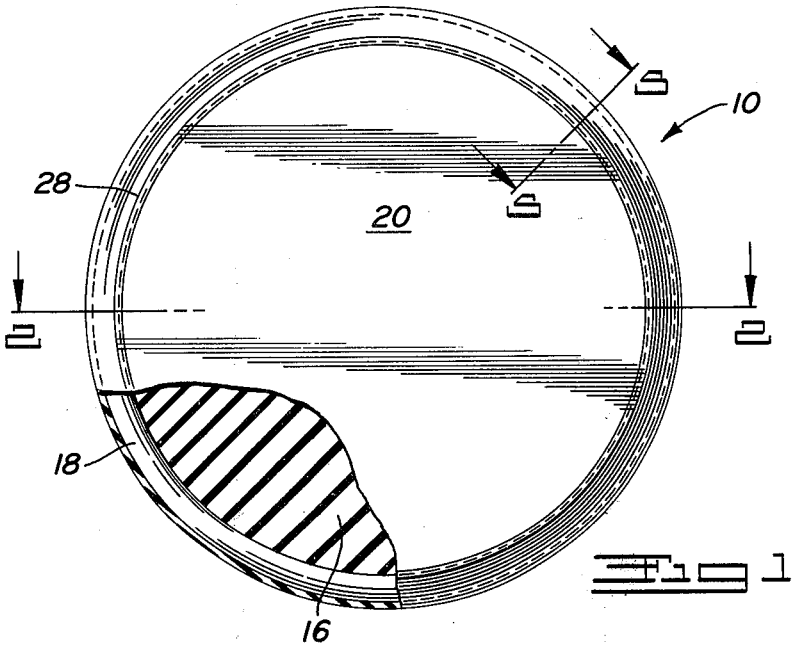
FIG. 1 is a partly cut-away plan view of the elastomeric bearing of the present invention as viewed along the line 1—1 of FIG. 2.

Referring to FIGS. 1 and 2, there is shown an elastomeric bearing structure 10 incorporated in load bearing relation and supporting a beam or deck 12 from a pier or foundation 14. Bearing structure 10 essentially comprises an elastomeric support body 16 retained or confined as shown by a plurality of tension support members 18. As understood and clearly shown in FIGS. 2 and 4–8, the tension support rings are embodied of metal in order to be substantially inextensible or unstretchable.

Bearing structure 10 is shown as being generally of inverted frusto-conical shape. Body 16 defines a lower surface or face 20 and an upper surface or face 22 bounded at their edges by a peripheral edge or surface 24. The rings 18 are shown as being completely embedded in the rubber body 16 about its peripheral edge 24. The rings or hoops 18 are disposed within the body as shown not only to create a more monolithic structure, but also to dispose the rings in vertically offset or staggered relationship as will become evident.

Figure 3:
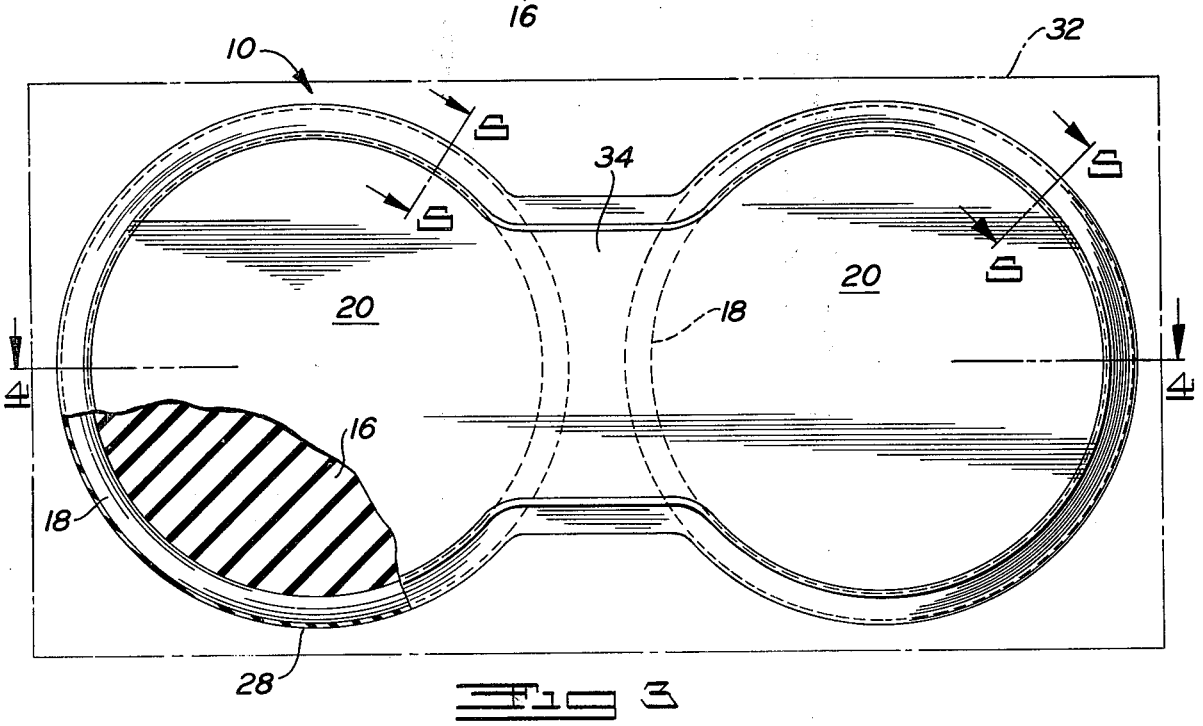
FIG. 3 is a partially cut-away plan view of an alternate embodiment of elastomeric bearing of the present invention.
Figure 5:
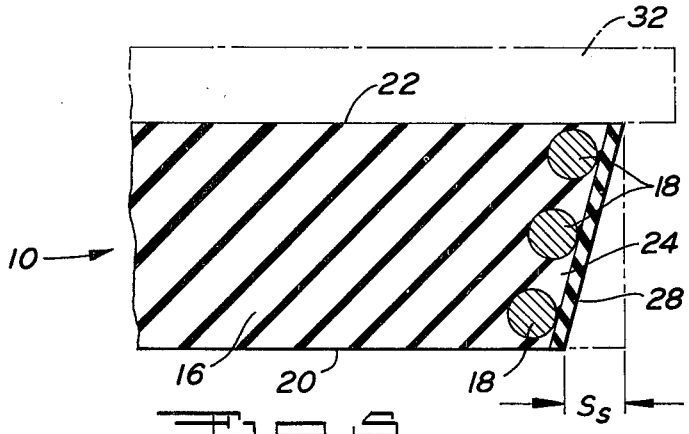
FIG. 5 is a detailed sectional view of one embodiment of the invention taken at line 5—5 of FIGS. 1 and 3.

FIG. 5 depicts a cross section of the bearing structure 10 taken at 5—5 of FIG. 1 and FIG. 3. As shown, the support rings 18 are disposed in the peripheral face 24 so as to leave selected areas for the rubber to bulge between adjacent rings 18 and a smaller selected distance between a designated ring and the upper or lower face of body 16. FIGS. 5—8 all illustrate exemplary vertical spacing for rings 18.

A basic concept herein is to substantially restrict the radial displacement over a large percentage of the rubber thickness (40% or more) when it is subjected to a compression load without appreciably affecting the shear strain characteristics. For example, FIGS. 1, 2 and 5–8 show the basic construction, which consists of a plurality of stress rings 18 which essentially encircle an elastomeric body. The summation of the cross sectional diameters of rings 18 should equal or exceed 0.4 of the thickness of support body 16.

When a compression load is applied to the bearing 10, the elastomer will tend to act as an incompressible fluid and exert forces in all directions. As a compression load is applied, a reduction in bearing height will result. Since elastomers are essentially incompressible, the reduction in bearing height forces the rubber body to extend radially. The elastomer located in the areas confined by the rings cannot displace radially since the rings 18 inhibit movement in that direction and is thus forced to displace into the nonrestricted areas between the rings.

However, the change in shape is also exerting forces which are trying to radially displace the elastomer but which inteferes with the tendency of the elastomer to freely enter the nonrestricted zones. The result of this configuration substantially reduces the amount of height reduction of body 16 under a given compression load. Whereas the shortest fiber length will be equal to the bearing thickness which is the longest possible for a given size bearing it is known that the fiber length is indirectly proportional to the shear load required to effect a shear strain rated as a percentage of such thickness i.e. the longer the fiber, the less shear load required for a given shear strain.

Other features are:

The body of the bearing is to be molded from a monolithic elastomer having good low temperature shear characteristics such as natural rubber, for example.

The exposed surface of the bearing is to be molded from an elastomer having good weathering, ozone and oil resistance characteristics such as neoprene.

The unrestricted rubber layer between faces 20 and 22 and the nearest respective ring 18 will be substantiallly less in thickness than the internal unrestricted layers between adjacent rings 18 to prevent "scrubbing" due to radial displacement.

A bearing may be molded as a short cylindrical column (FIGS. 6–8) in lieu of a frustum of a right circular cone (FIGS. 2 and 5). This would involve the use of stress rings of unequal outside diameters.

A bearing may be molded incorporating multiples of the basic bearing in combination, (for example as shown in FIG. 3) which would allow the bearing to be placed on a rectangular bearing seat which are most commonly used and reduce the magnitude of the hoop tension of the respective rings of the multiple combination for a given compressive load as compared to one of the larger rings of a larger basic bearing as described.

A bearing would be molded having some of the rings 18 unequal in outside diameter which would give a staggered or offset ring configuration (FIGS. 5–8) which would allow additional bearing rotation without excessive localized compression stress between the rings. Also, the offset or staggered configuration of rings 18 would permit the rings to be of selected larger cross-sectional diameter, giving a larger total accumulative ring height relative to total thickness of body 16 to provide substantially greater confinement and corresponding unit loading with substantially undiminished capability for movement in lateral shear.

The different embodiments disclosed and their variations may be molded with either or both of faces 20 or 22 bounded to a sole plate and the number and diameter of rings 18 provided may vary to fulfill shear movement requirement, unit loading, rotational requirement and shape factor.

The function of the rings 18 is to effectively increase the shape factor S of bearing structure 10 by dividing the peripheral area of edge 24 into smaller discrete areas subject to bulge while the area of surface 22, subject to vertical loading, remains constant. Concurrently, the total thickness of support body 16 effectively remains available for deflection in lateral shear. If prior art type laminations of plates of the same thickness as the diameter or accumulative height of rings 18 were substituted in lieu of rings 18, then the increase in shape factor would be substantially the same but the thickness and volume of rubber available for lateral shear equivalent to plate thickness would be lost.

As shown in FIGS. 1, 2 and 5 and previously mentioned, bearing 10 is formed in the shape of a truncated cone with parallel faces 20 and 22 and by the tapered edge or surface 24. As later discribed with reference to FIGS. 6–8, bearing 10 may also be provided in the shape of a short cylinder with the edge 24 being disposed perpendicular to the faces 20 and 22. The embodiment of FIGS. 1, 2 and 5 illustrates a structure which provides a constant load carrying area of elastomer equivalent to the area of surface 20 throughout the permissable lateral shear deflection of bearing 10 as caused by lateral movement of the beam 12. FIGS. 1 and 5 show dashed lines indicative of the position and shape attained by bearing 10 through a shear displacement distance $S_s$. The distance $S_s$ indicates the designated movement in shear provided by the angle of taper of edge 24 to bring a portion of edge 24 to a posture which is perpendicular to faces 20 and 22 when the maximum permitted lateral movement is attained.

Each ring 18 is shown in FIGS. 2 and 5 to be embedded in the face 24 in vertically displaced apart and laterally offset relation with respect with each adjacent ring. In this embodiment the offset relation of the rings conveniently conform to the profile of the tapered surface of edge 24. More significantly, the effective lateral unconfined bulge area between adjacent rings may be reduced while the effective distance between the rings remain at an optimum to permit maximum rotational deflection within the bearing as caused by deflection of a supported beam 12, for example, and also to permit substantially uninhibited lateral movement in shear or body 16 commensurate with the full thickness of the rubber mass.

Though several kinds of natural and synthetic rubber may be provided for support body 16, a natural rubber of 40–50 durometer hardness is recommended, for example. The reason that natural rubber is preferred is that natural rubber has the most consistent shear modulus with various changes of temperature, as compared with some of the synthetic rubbers which exhibit a marked increase in shear modulus with comparable decreases in temperature.

Since natural rubber is less ozone resistant and more prone to deterioration from weathering, a protective sheath 28 (FIGS. 1–8) may be provided which is bonded to surface 24. The preferred material for sheath 20 is neoprene, selected for its superior ozone and weathering resistance. Other protective materials may be provided, however, such as certain grades of butyl rubbers, ehtylene polypropylene rubbers, polysulfide rubbers, silicone rubber and the like as dictated by effectiveness vs. price.

The embodiment of FIG. 5 is illustrated as being provided with three rings 18 disposed in both vertically spaced apart and laterally offset relation as shown. However, it is evident that the benefits of this invention may be attained by providing two or more of such rings disposed in vertically spaced apart and laterally offset or staggered relation, the number provided being dependent upon the cross-sectional diameters of each ring, the expected rotational and lateral movement to be imposed on body 16, the shape factor desired and related loading conditions.

Figure 6:
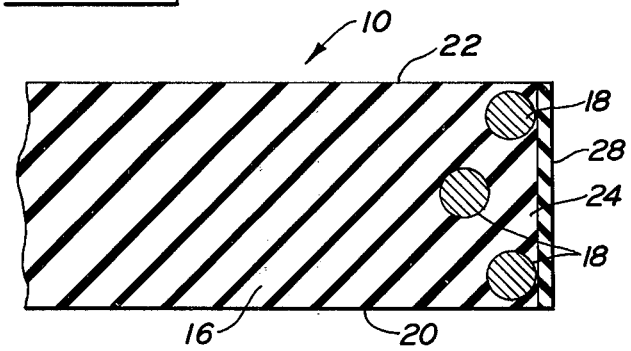
FIG. 6 is an alternate embodiment of the structure shown in FIG. 5.

FIG. 6 illustrates an alternate embodiment of the structure shown in FIGS. 2 and 5. In this embodiment the peripheral edge 24 is provided perpendicular to the surfaces 20 and 22. Three rings 18 are disposed in embedded relation about the edge 24 with each ring 18 being disposed both in vertically spaced apart and laterally staggered relationship relative to an adjacent ring or rings 18 as shown. The upper and lower rings 18 are of greater diameter or peripheral length than the center ring and consequently are disposed closer to edge 24 than the center ring. The upper and lower rings 18 are also disposed close to surfaces 20 and 22 respectively to prevent "scrubbing", as previously mentioned, when no sole plates are provided. The accumulative cross-sectional height of the rings 18 is shown as being not less than about 40% of the total thickness of body 16. Routine tests conducted with a selected elastomer for body 16 and with the support rings 18 being selected cross-sectional height and being disposed in selected vertical and lateral spaced apart relationship can result in an accumulative height of the rings 18 being somewhat greater or less than 40%, depending on a desired rating of structure 10 for vertical loading, lateral displacement, rotational requirement and/or shape factor. It is to be seen that the lateral distance between adjacent rings will permit vertical compression strain of body 16 without direct decrease in the effective distance between adjacent rings through the vertical decrease in distance between adjacent rings will be linear with such compressive strain.

As with the embodiment of FIG. 5, the body 16 of FIG. 6 may be provided with a protective sheath 28 bonded about the surface of edge 24 as shown.

Figure 7:
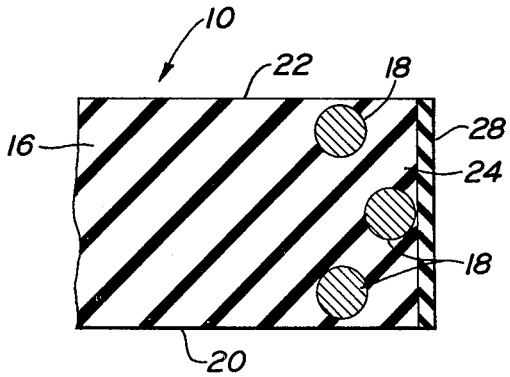
FIG. 7 is another embodiment of the structure shown in FIG. 6.

FIG. 7 depicts an embodiment similar to that of FIG. 6 with the difference being that the center ring 18 is provided of greater peripheral diameter than the adjacent rings and accordingly is closer to edge 24. This embodiment will function substantially the same as the embodiments of FIGS. 5 and 6 when supporting the beam 12 through vertical loading, horizontal or lateral deflection and/or deflectional rotation of the beam as previously mentioned. When a beam 12 is supported from a pier 14 by any of the embodiments of bearing 10 as shown in FIGS. 5–7, the bearing 10 is considered to provide a "floating" type of support for a beam 12 which will support the vertical loading from the beam 12 and also accommodate the various horizontal and rotational movements of the beam.

Figure 8:
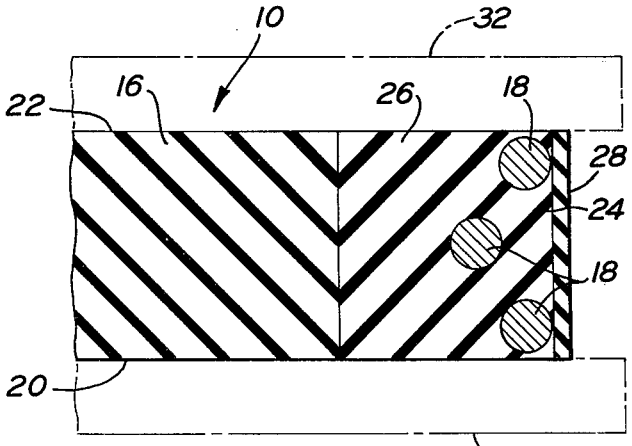
FIG. 8 is a further modification of the embodiment shown in FIG. 6.

FIG. 8 differs from the embodiments of FIG. 6 by the provision of support body 16 including a central body surrounded by a peripheral elastomeric retaining body 26. When provided as shown, the bulging action of retaining body 26 replaces the bulging action of the rubber central body of support body 16. Retaining body 26, as preferably provided, will be in the range of 50–60 durometer or a suitable range of greater hardness which is more resistant to deformation than the central body of support body 16. When the retaining body 26 is provided as shown, the bearing structure 10 is capable of handling greater loads since the harder rubber requires more applied force to bulge out between the rings 18.

When the bearing structure 10 is under a loaded condition such as depicted in FIG. 2, the elastomeric body 16, particularly near the center, behaves as a semiperfect liquid transferring vertical loading stresses to lateral stresses tending to cause the periphery of the member to bulge, as previously described. As shown in FIG. 8, the peripheral retaining body 26 acts as a "dam", confining the elastomeric body 16 and transmitting its force into bulges of the harder material between the rings 18. This arrangement provides increased vertical loading capacity. However, the resistance of the element 26 to lateral forces creating stresses in shear of the bearing structure 10 as a whole is not sufficient to be appreicable or undesirable.

The ghost lines in FIGS. 3, 4, 5 and 8 are to illustrate the optional upper sole plate 32 and/or an optional lower sole plate 30. When such sole plates are provided, they are firmly bonded to the rubber and fillet (not shown) is provided at the outer intersection of the rubber to the plate to minimize stress risers when the plates place the rubber in shear, compression or rotation. The purpose of the plates is for welding, bolting, or otherwise attaching the upper plate 30 to beam 12 when beam 12 is provided of metal rather than concrete as shown. Lower plate 30 is likewise provided for immovable attachment to pier 14 if the pier provided of steel or otherwise presenting a low friction coefficient to bearing structure 10.

It is pointed out that variations of the elements shown in FIGS. 4–8, such as sole plates 30 and 32, protective sheath 28, retaining body 26, and the number of rings 18 may be varied and combined as desired for a particular design and environmental condition, all within the purview of the present invention. It is also to be noted that retaining body 26 and sheath 28 may be combined as a common body formed of neoprene or the like as desired.

Figure 4:
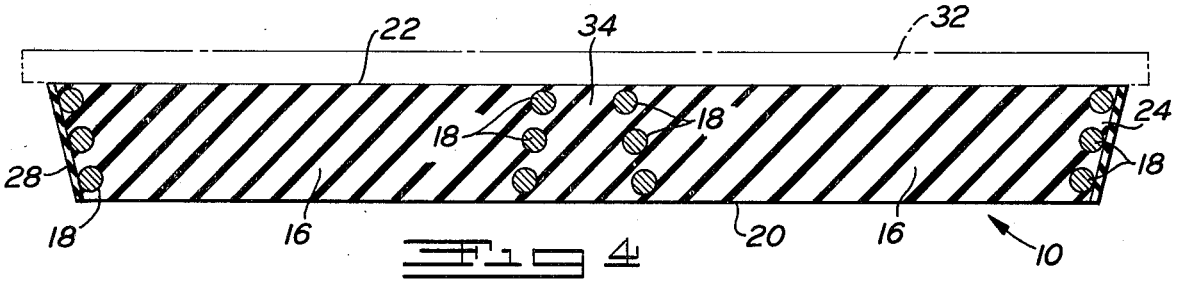
FIG. 4 is a sectional view taken at line 4—4 of FIG. 3.

FIGS. 3 and 4 depict another embodiment of the invention wherein two of the bearing structures 10 are combined with a connecting elastomeric spanning member 34. The structure of FIG. 3 behaves substantially as described for the structure of FIGS. 1 and 2, but is shown to illustrate that more than one of the bearing structures 10 may be utilized in combination. Additional bearing structures 10 may be arranged in desired goemetric relation depending on the size and shape of beams such as 12 to be supported and available support area on piers or foundations 14. For example, three of the bodies 16 may be combined to provide a bearing 10 of generally triangular configuration. Four bodies 10 may be combined for a bearing 10 of square configuration. Six bodies 10 may be combined for a larger triangular or rectangular configuration and so on.

Bearing 10 has been described as frusto-conical or disc shaped with tension support members or rings 18 being circular in configuration. It is apparent that rings 18 would be urged to become circular upon application of loading force to bearing 10 which would place rings 18 under hoop stress as the elastomer body 16 seeks to deform under compression. However, rings 18 may have initial configurations other than exactly circular. For example, rings 18 may be provided of elliptical shape (not shown). When so provided, the minor diameter of the ellipse so formed may be restrained in shape by means of a tie rod or bar (not shown) connected to each ring 18 across the minor diameter.

It is also noted that corresponding rings 18 of adjacent bodies 16, such as shown in FIG. 3, might be a single ring or hoop formed in the shape of a figure "8" approximately as shown and joined at its waist with a tie rod or other appropriate connection.

The foregoing description and drawing will suggest other embodiments and variations to those skilled in the art, all of which are intended to be included in the spirit of the invention as set forth herein.

That being claimed is:

1. An internally reinforced elastomeric bearing structure adapted to support a tilting and laterally movable load without external support or confinement within an enclosure, comprising:

a. a substantially flat monolithic elastomeric support body defining an upper surface disposed in parallel spaced apart relation with a lower surface and a peripheral edge bounding the perimeters of said surfaces;

b. a plurality of inextensible tension support rings embedded in said peripheral edge and around the periphery of said support body with each support ring being selectively disposed both in laterally spaced apart relation and in vertically spaced apart relation to the next adjacent support ring, and said support rings extending serially from close to the top surface to the close to bottom surface of said support body.

2. The structure of claim 1 wherein said support member is comprised of a natural rubber of about 40–50 durometer in hardness and includes a protective neoprene sheath disposed in bonded relation to the surface of said peripheral edge.

3. The structure of claim 1 wherein said support body includes an elastomeric central body of about 40–50 durometer horizontally surrounded by an elastomer retaining body of about 50–60 durometer with said tension support rings embedded as aforesaid within the edge of said retaining body.

4. The structure of claim 1 further including a metal sole plate bonded to at least one of said lower surface and said upper surface.

5. A structure comprising a plurality of bearing structures as defined in claim 1 with said bearing structures being formed together to provide a preselected load bearing configuration adapted to function cooperatively in combination.

6. The structure of claim 1 wherein the effective cumulative total vertical thickness of said support rings in established through selection of the elastomer for said support body, selection of the cross-sectional height of each said support ring and selection of the lateral and the vertical spaced apart relationship of said rings.

7. The structure of claim 6 wherein said support rings have a cumulative total vertical thickness of not less than about 40% of the total thickness of said support body.

* * * * *

UNITED STATES PATENT AND TRADEMARK OFFICE

CERTIFICATE OF CORRECTION

PATENT NO. : 3,938,852

DATED : February 17, 1976

INVENTOR(S) : Richard D. Hein, John A. Welch, James E. Britton

It is certified that error appears in the above-identified patent and that said Letters Patent are hereby corrected as shown below:

Column 10, line 29 - delete "the" before "close" and insert ---the--- before "bottom"

Column 10, line 38 - delete "elastomer" and substitute ---elastomeric---

Signed and Sealed this

*eighteenth* Day of *May 1976*

[SEAL]

*Attest:*

RUTH C. MASON
*Attesting Officer*

C. MARSHALL DANN
*Commissioner of Patents and Trademarks*